US009039058B1

(12) United States Patent
Henry

(10) Patent No.: US 9,039,058 B1
(45) Date of Patent: May 26, 2015

(54) UTENSIL MANIPULATING ARTICLE

(71) Applicant: Jesse Edward Henry, Houston, TX (US)

(72) Inventor: Jesse Edward Henry, Houston, TX (US)

( * ) Notice: Subject to any disclaimer, the term of this patent is extended or adjusted under 35 U.S.C. 154(b) by 0 days.

(21) Appl. No.: 13/936,336

(22) Filed: Jul. 8, 2013

Related U.S. Application Data

(60) Provisional application No. 61/673,854, filed on Jul. 20, 2012.

(51) Int. Cl.

| | |
|---|---|
| ***B65D 65/14*** | (2006.01) |
| ***A47G 21/10*** | (2006.01) |
| ***B65D 65/22*** | (2006.01) |
| ***A47G 21/02*** | (2006.01) |

(52) U.S. Cl.
CPC ..... *B65D 65/22* (2013.01); *A47G 21/02* (2013.01)

(58) Field of Classification Search
USPC ..... 294/131, 8.5, 25, 33, 99.1, 99.2; 383/40, 62, 124, 126, 127; 229/400, 229/103.2, 108.1, 117.3, 402; 221/210, 259
See application file for complete search history.

(56) References Cited

U.S. PATENT DOCUMENTS

| | | | | | |
|---|---|---|---|---|---|
| 416,849 | A * | 12/1889 | Neale | 294/131 |
| 2,234,065 | A * | 3/1941 | Vogt | 383/210 |
| 2,385,647 | A * | 9/1945 | Poppe | 383/124 |
| 4,993,845 | A * | 2/1991 | Faltynek | 383/40 |
| 5,044,776 | A * | 9/1991 | Schramer et al. | 383/89 |
| 5,163,756 | A * | 11/1992 | Riseman | 383/127 |
| 5,534,346 | A | 7/1996 | Robinson | |
| 5,699,614 | A | 12/1997 | Garneau | |
| 5,806,099 | A | 9/1998 | Grinberg | |
| 5,975,083 | A | 11/1999 | Henderson | |
| 6,206,570 | B1 * | 3/2001 | Cortopassi | 383/127 |
| 6,298,491 | B1 | 10/2001 | Blustin et al. | |
| 6,517,243 | B2 * | 2/2003 | Huffer et al. | 383/88 |
| D487,003 | S * | 2/2004 | de Groote | D7/686 |
| 7,416,768 | B2 * | 8/2008 | Knoerzer et al. | 428/40.1 |
| D673,056 | S * | 12/2012 | Gallas | D9/703 |
| 2003/0131393 | A1 | 7/2003 | Votolato | |
| 2007/0210596 | A1 | 9/2007 | Stewart et al. | |

* cited by examiner

*Primary Examiner* — Paul T Chin

(74) *Attorney, Agent, or Firm* — Egbert Law Offices, PLLC

(57) ABSTRACT

A utensil manipulating article has a sleeve formed of a pliable material. The sleeve is suitable for receiving the utensil therein. The sleeve is movable between a utensil-receiving position and a utensil-manipulating position. The sleeve has an adhesive material on an outer surface thereof. The adhesive is suitable for attaching to fingers of a user so as to allow the user to move the sleeve between the utensil-receiving position and the utensil-manipulating position. The adhesive material includes a first adhesive strip and second adhesive strip respectively placed on a first side and an opposite side of the sleeve. A liner is removably affixed over the first and second adhesive strips.

19 Claims, 2 Drawing Sheets

UTENSIL MANIPULATING ARTICLE

RELATED U.S. APPLICATIONS

The present application claims priority from U.S. Provisional Patent Application Seri. No. 61/673,854 filed on Jul. 20, 2012, and entitled "Disposable Utensil Cup".

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to sanitary articles that are used for the protection from cross-contamination of germs at salad bars and buffets. More particularly, the present invention the relates to sanitary articles whereby various kitchen and buffet utensils can be easily used and manipulated with the sanitary article.

2. Description of Related Art Including Information Disclosed Under 37 CFR 1.97 and 137 CFR 1.98.

During the past twenty years. Americans have seen the increase of both spouses entering the workforce. This has resulted in an increase in spendable income for the family. This increase in income permits the family to enjoy such luxuries as two cars, color television and luxurious vacations. Also, Americans, in general, are spending more time away from home for both Work and pleasure. As a result, more people are eating their meals in restaurants.

Buffets are one of the most popular forms of restaurants. Buffets typically include many different types of appetizers, salads, entrees and desserts placed in food trays along a buffet table.

Spoons, forms, and tongs are generally provided with each buffet dish. The customer or patron uses the utensils to remove as much food as he or she desires from the buffet dish onto their plates and then places the utensils back into the buffet dish. The patron continues this process throughout the buffet table, and then goes to his or her seat to eat the food using food utensils provided by the restaurant.

Sanitation cross-contamination has always been a concern of buffet restaurant owners, as well as the restaurant customers. Restaurant owners are well aware of the economical and devastating effect that results from an outbreak of food poisoning in a restaurant.

Great progress has been made in mandating the supervision of food preparation and employee's personal hygiene within the restaurant industry in order to safeguard the future of the dining-out segment of the food service industry. However, this is not good enough, since customer cross-contamination is also possible in the buffet environment by various customers using the same buffet food utensils. It is known that certain pathogens like *salmonella*, streptococcal, *E. Coli* and Staph congregate on human bands and may be passed among customers using the same utensils. Also, Hepatitis A may likewise be passed among customers in the same manner. Moreover, the bacteria and virus also can contact the food, thereby contaminating the food.

To overcome this cross-contamination problem, it has been proposed to issue disposable gloves to buffet customers.

However, the use of such gloves has been rejected for several reasons, namely: (1) the patrons resentment of the inference that they have unclean hands; (2) the unwillingness of the patron to wear disposable gloves; (3) the inconvenience of putting on and removing the gloves while holding a plate of food, plus the awkward appearance of everyone wearing gloves; and (4) the gloves are easily contaminated by touching other items, thereby giving the wearer a false sense of security.

It has also been suggested that the patron be issued his or her own utensils for use only with the buffet dishes. However, this would require an inordinate number of serving, utensils and is, therefore, not practical.

In the past, various patents have issued relating to such sanitary articles. For example, U.S. Pat. No. 5,699,614, issued on Dec. 23, 1997 to J. P. Garneau, shows an attachable and removable handle for food serving utensils. The utensil has a first portion and a handle. The first portion includes a utensil portion. The handle is removably attached to end of the shank of the utensil portion. A spring-loaded clamp is provided with the handle to coact with the shank so as to engage the shank with the handle.

U.S. Pat. No. 5,806,099, issued on Sep. 15, 1998 to D. Grinberg, discloses a disposable mitt that has a mitt body formed of front and back layers of plastic sealed around the periphery thereof so as to form a closed end and an open end and forming a thumb portion and one or more finger portions. A detachable section extends from the back layer adjacent the open end of the mitt body and has a line of weakness, such as a perforation, suitable for separation of the detachable portion from the mitt body. The detachable portion also includes means to mount the mitt assembly on a support structure U.S. Pat. No. 5,975,083, issued on Nov. 2, 1999 to R. E. Henderson, shows a method and apparatus for providing a sanitary barrier for a users hand. In particular, this includes the steps of providing a supply of segments of polymeric film on an elongated roll. Each segment has a surface that enables the segment to adhere to a users hand when the user places his or her hand against the surface. The dispenser can provide a backing place for holding the free end of the roll so that when the user applied pressure to the free end of the roll at the segment to be dispensed, the user's hand presses against the film segment and the underlying backing plate.

U.S. Pat. No. 6,298,491, issued on Oct. 9, 2001 to Blustin et al, provides a disposable glove that has a first and a second juxtaposed-shaped films of heat resistant plastic material. The films are sealed together around their peripheries. These are positioned so as to accommodate the insertion and withdrawal of a hand.

U.S. Pat. No. 5,534,346, issued on Jul. 9, 1996 to W. B. Robinson, discloses a disposable prophylatic barrier. The barrier is of a planar transparent plastic sheet having a low-tack pressure-sensitive adhesive over a portion of a surface thereof. The sheet is bulk-dispensed from a roll.

U.S. Patent Publication No. 2003/0131393, published on Jul. 17, 2003 to E. J. Votolato, describes a utensil for eliminating bare hand handling of sensitive material. The utensil includes a pair of pockets for receiving a user's hand and is formed of a flexible material. Each of the pockets has an open end, a closed end and a pair of sides. One side of each pocket is flat and arranged in opposition to the other so as to form opposing sides. A hinge joins together the pair of pockets at the opposing sides and at the open ends thereof. The hinge biases the pockets in a closed position such that the pair of pockets are separable by the user for gripping the sensitive material with the opposing sides at the closed ends of the pockets.

U.S. Patent Publication No. 2007/0210596, published on Sep. 13, 2007 to Stewart et al, teaches finger tongs. These finger tongs include a front tong element flexibly binged to a rear tong element to form a seamless one piece structure. Additional elements include scooping tips, different sized and shaped gripping and grasping elements, and heat-shrink hand protectors. These are connected to each other and to a hinge point surrounded by a hand protection area.

It is an object of the present invention to provide a disposable utensil cup that minimizes the transfer of germs during the handling of serving utensils.

It is another object of the present invention to provide a disposable utensil cup that easily allows the users to manipulate the utensils.

It is another object of the present invention to provide a disposable utensil cup which can be easily applied to the fingers of the users.

It is still another object of the present invention to provide a sanitary article that is disposable following use.

It is still a further object of the present invention to provide a disposable utensil cup that is easy to use, easy to manufacture and relatively inexpensive.

These and other objects and advantages of the present invention will become apparent from a reading of the attached specification and appended claims.

BRIEF SUMMARY OF THE INVENTION

The present invention is a utensil manipulating article that has a sleeve formed of a pliable material. The sleeve is suitable for receiving the utensil therein. The sleeve is movable between a utensil-receiving position and a utensil-manipulating position. The sleeve has an adhesive material on an outer surface thereof. The adhesive is suitable for attaching to fingers of a user so as to allow the user to move the sleeve between the utensil-receiving position and the utensil-manipulating position.

In the present invention, the sleeve has an open end of one end thereof and a closed end at an opposite end thereof.

The adhesive includes a first adhesive strip extending, along one side of the sleeve and a second adhesive strip extending along an opposite side of the sleeve. The first adhesive strip and the second adhesive strip are may or may not be contiguous. The first adhesive strip and the second adhesive strip optionally define a tab extending outwardly of an end of the sleeve. A liner is removably affixed over the first and second adhesive strips. The liner has a non-adhesive outer surface. The liner has a flap formed thereon. The flap is suitable for allowing a user to remove the covering from the first and second adhesive strips. The cover extends continuously along a length of the first and second adhesive strips. The first adhesive strip extends lengthwise along the one side of the sleeve. The second adhesive strip extends lengthwise along the opposite side of the sleeve. The first adhesive strip is positioned centrally on the first side. The second adhesive strip is positioned centrally on the second side.

Within the concept of the present invention, a tab is affixed to the sleeve and extends outwardly of the closed end of the sleeve. The sleeve has gusseted edges formed between the first and second sides of the sleeve.

The foregoing Section is intended to describe, in generality, the preferred embodiment of the present invention. It is understood that modifications to this preferred embodiment can be made within the scope of the present invention without departing from the true spirit of the invention. As such, this Section should not be construed, in any way, as being limiting of the scope of the present invention. The present invention should only be limited by the following claims and their legal equivalents.

DETAILED DESCRIPTION OF THE INVENTION

Figure 1:
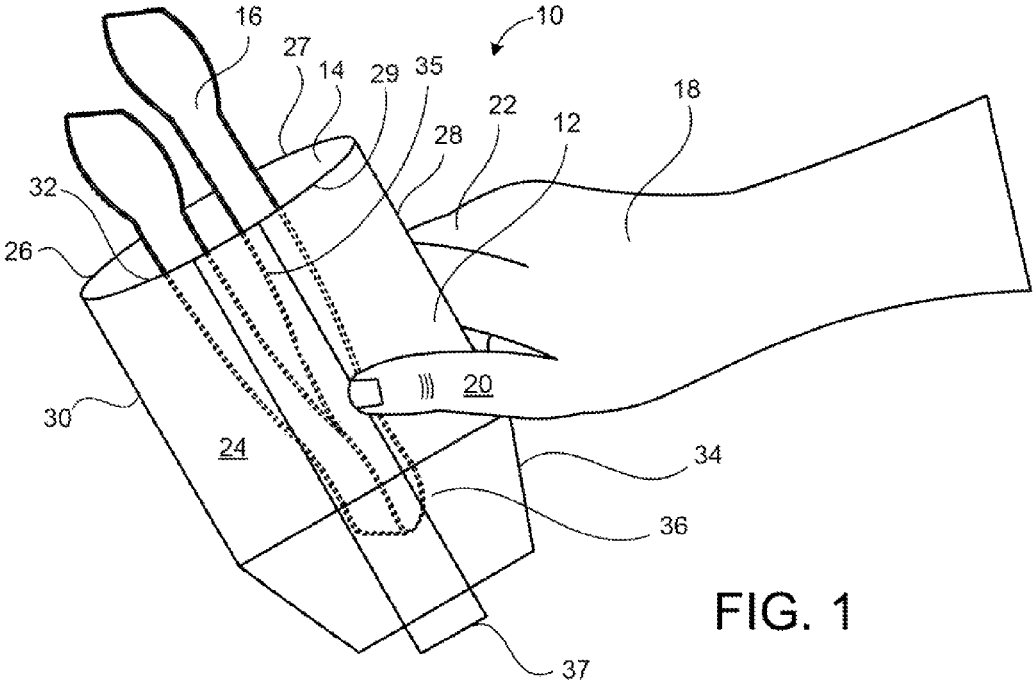
FIG. 1 is a perspective view showing the application of the utensil manipulating article of the present invention as used in association with tongs.

Referring to FIG. 1, there is shown the utensil manipulating article 10 in accordance with the preferred embodiment of the present invention. The utensil manipulating article 10 is in the form of a sleeve 12. The sleeve 12 is formed of a pliable material. The sleeve is suitable for receiving a utensil therein, in FIG. 1, it can be seen that the interior 14 of the sleeve 12 receives tongs 16 therein. A hand 18 is illustrated as having a thumb 20 positioned on one side of the sleeve 12 and fingers 22 positioned on the opposite side of the sleeve 12, In particular, the thumb 20 can be placed onto the side of the sleeve 12 corresponding to one side of the tongs 16. The fingers 22 can be placed on the opposite side of the sleeve 12 in an area corresponding to the other side of the tongs 16. As such, by compressing the sides of the sleeve 12, the sleeve 12 can be manipulatable between a utensil-receiving position and a utensil manipulating position.

The sleeve 12 has a first side 24 and a second side 26. The first side 24 is joined to the second side 26 along edges 28 and 30. Edges 28 and 30 allow the first side 24 to hinge with respect to the second side 26. As such, the use of the lingers 20 and 22 of the hand 18 allows for a proper manipulation of the tongs 16 located within the interior 14 of the sleeve 12.

The side 24 has an outer surface and an inner surface. Similarly, the second side 26 has an outer surface and an inner surface. The thumb 20 is placed against the outer surface of the first side 24. The fingers 22 are placed against the outer surface of the second side 26. The interior surfaces of the first side 24 and the second side 26 define the interior 14. The second side 26 has at lip 27 that extends outwardly a distance beyond edge 29 of the first side 24.

The tongs 16 are placed through an open end 32 of the sleeve 12, The opposite end of the sleeve 12 includes a surface that is generally adjacent to the end 36 of the tongs 16. In the preferred embodiment of the present invention, the end 34 is generally flat so as to cause a comfortable fit against the palm of the hand 18. Also within the concept of the present invention, the end 34 can be suitable gusseted so as to expand, as required, so as to accommodate the size of the end of the tongs 16. The lip 27 helps to guide the tongs 16 into the interior of the sleeve 12. The lip 27 also facilitates the ability to separate side 24 from side 26.

In FIG. 1, it can be seen that there is a first adhesive strip 35 that is affixed to the side 24 so as to extend therealong. Another adhesive strip will be placed on the opposite side 26 of the sleeve 12. The adhesive strips are suitable for attaching to the fingers of the user so as to allow the user to move the sleeve 12 between the utensil-receiving position and the utensil manipulating position. As will be described hereinafter, the adhesive, strip will have a liner thereover. This liner will be in the nature of a paper or plastic film which can be easily removed so as to expose the adhesive material on the adhesive strips. In FIG. 1, it can be seen that the adhesive strip 35 has a lower portion 37 which extends outwardly beyond the ends 34 of the sleeve 12. As such, this can serve as a tab. The tab can be useful for allowing a user to remove the sleeve 12 from a stack of sleeves so that the sleeve 12 can be quickly employed.

Within the concept of the present invention, any number of utensils can be received within the interior 14 oldie utensil manipulating article 10. The tongs 16 are shown for illustration purposes only. Various items such as spoons, forks, skewers, knives, and other items, can also be received within the interior 14. As such, the utensil manipulating article 10 is applicable to a wide variety of utensils that would be provided in a buffet-style restaurant operation.

Figure 2:
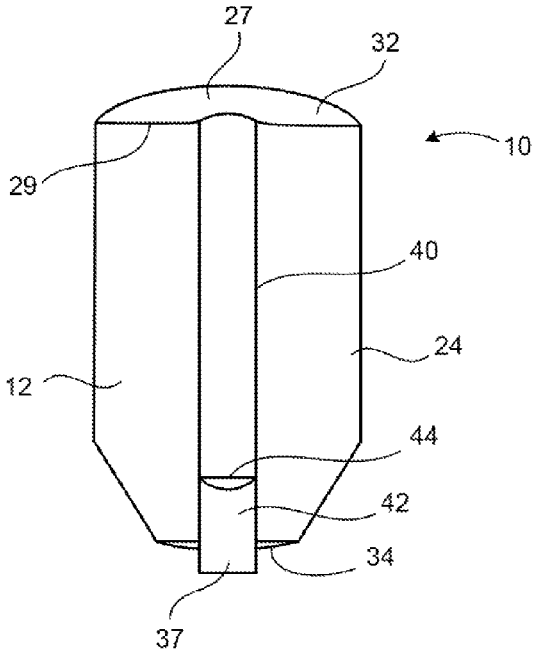
FIG. 2 is a side elevational view of the utensil manipulating article of the present invention.

FIG. 2 illustrates a side view of the utensil manipulating article 10 of the present invention. In particular, the first side 24 is illustrated. There is an adhesive strip 40 that extends lengthwise along, the first side 24. The adhesive strip 40 is positioned generally centrally of the first side 24. A corresponding adhesive strip can be placed on the opposite side 26 of the sleeve 12. The adhesive strip 40, along with the adhesive strip on the opposite side 26 of the sleeve 12, can be contiguous or can be provided as separate adhesive strips. The adhesive strip 40 has an adhesive surface that faces outwardly of the first side 24. The adhesive strip 40 will have a suitable adhesive quality so that the fingers 20 and 22 of the hand 18 can be easily released from the utensil manipulating article 10. A protective film 42, in the nature of a covering, extends along the adhesive strip 40 so as to cover the adhesive until such time it is necessary to use the utensil manipulating article 10. A flap 44 is folded inwardly or outwardly so as to allow the user to easily remove the protective film 42 from the adhesive strip 40, Once the protective film 42 is removed, the adhesive faces outwardly so that the user can easily gasp the sides 24 and 26 of the sleeve 12. The protective film 42 will have a width equal to the width of the adhesive strip 40 and a length generally equal to the length of the adhesive strip 40. If a single adhesive strip 40 is used on both sides 24 and 26 of the sleeve, then the protective film 42 can have a continuous length extending over these adhesive strips.

In FIG. 2, it can be seen that the tab 37 extends outwardly beyond the bottom 34 of the sleeve 12. As such, the adhesive strip 40, as covered, with the protective film 42, can serve as a proper tab extending outwardly beyond the bottom 34. Alternatively, within the concept of the present invention, a separate tab can be attached to the bottom 34 so as to facilitate the removal of the sleeves 12 from a stack of sleeves. Also, in FIG. 2, it can be seen that lip 27 extends outwardly beyond the edge 79.

Figure 3:
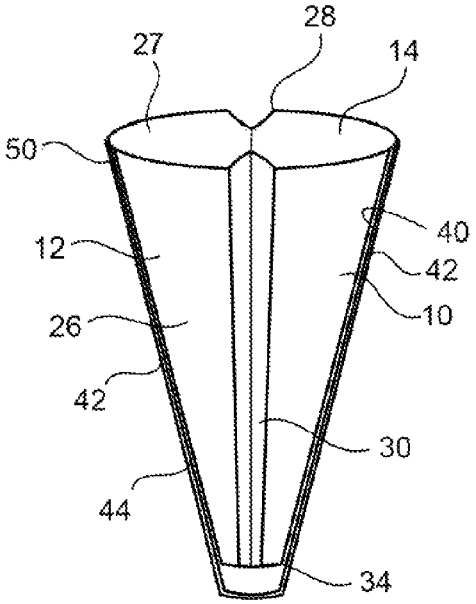
FIG. 3 is a side view of the utensil manipulating article of the present invention.

FIG. 3 shows a side view of the utensil manipulating article 10 of the present invention. In particular, it can be seen that there is an edge 30 that connects the first side 24 to the second side 26. The edges of the sides 24 and 26 are joined together along the edge 30 and the edge 28 so as to allow these walls to hinge with respect to each other. In FIG. 3, it can be seen that this edge 30 is a gusseted edge. As such, this enhances the structural integrity of the sleeve 12 and also facilitating the ability to expand the interior 14 of the sleeve 12. Similarly, the bottom 34 can also be gusseted so as to enhance the size of the bottom, where desired.

In FIG. 3, it can be seen that the side 24 has the adhesive strip 40 extending therealong. The protective film 42 overlies the adhesive strip 40 and extends therealong. Similarly, the adhesive strip 50 extends along the opposite side 26 of the sleeve 12. The protective film 42 also overlies the adhesive strip 40. The flap 44 is provided on the protective film 42 so as to enhance the ability to remove the protective film from the adhesive surface of the adhesive strips 40 and 50. In FIG. 3, the adhesive strips 40 and 50 are contiguous. Also, the protective film is continuous so that it continuously overlies the surfaces of the adhesive strips.

Figure 4:
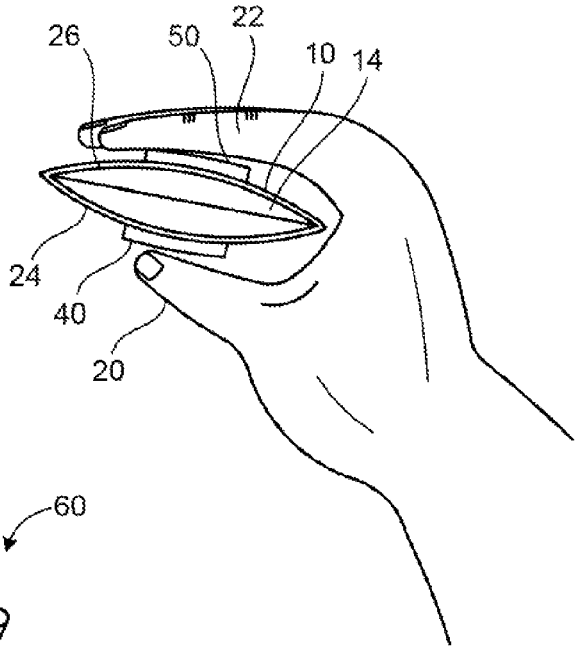
FIG. 4 is an end view showing the utensil manipulating article of the present invention as placed between the fingers of a user.

FIG. 4 illustrates the operation of the utensil manipulating article 10 of the present invention. In particular, it can be seen that the fingers 22 are placed against the adhesive strip 50 on the second side 26. Similarly, the thumb 20 is placed against the adhesive strip 40 on the first site 24. When the thumb 20 is moved away from the fingers 22, the interior 14 of the sleeve 12 will open so as to allow the utensil to be received therein. When the thumb 20 is moved toward the fingers 22, the interior 14 will close upon the utensil. The adhesive strips 40 and 50 facilitate the ability to open the sleeve 12 and to otherwise manipulate the opening and closing of the sleeve. Hence, in the preferred embodiment of the present invention, the sides 24 and 26 are of a paper-type material. The sleeve 12 will not open and close unless proper forces are applied, in combination with the adhesive. As such, the adhesive allows for the desired manipulation of the utensil manipulating article 10 of the present invention.

Figure 5:
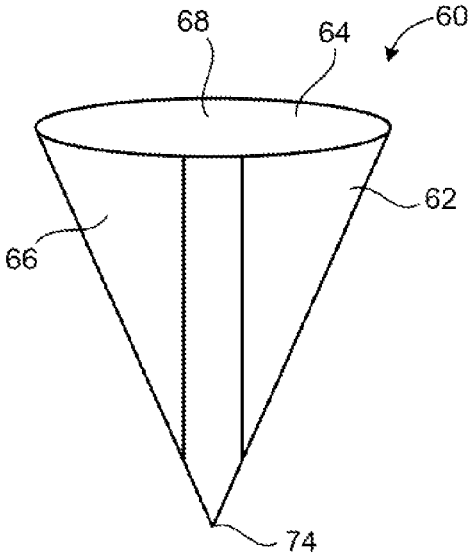
FIG. 5 is an alternative embodiment of the utensil manipulating article of the present invention.

FIG. 5 illustrates an alternative embodiment of the utensil manipulating article 60 of the present invention. In FIG. 5, it can be seen that the utensil manipulating article 60 has a cup-shaped body 52 with an interior 64. The first side 66 is joined along its edges to the second side 68. A first adhesive strip 70 is applied across a surface of the first side 66. A similar strip of adhesive can be applied across the second side 68. As such, unlike the previous embodiment, the embodiment of FIG. 5 shows a pair of adhesive strips formed separately on each of the sides 66 and 68. The end 74 is generally pointed such that the cup-shaped body 62 has an appearance of a snow-cone cup. A separate suitable protective film can be applied to the adhesive strip 70 on the opposite side of the cup-shaped body 62.

The present invention utilizes the utensil manipulating article having the means formed thereon to flex the open end thereof between an open and a closed position. The lip 27 facilitates the ability to open the sleeve. The handle of a serving utensil is received into the open end of the utensil manipulating article in its open configuration. The lip 29 enhances the ability to slide the utensil into the open end of the sleeve. The open end of the sleeve can be flexed into the closed position so as to engage the handle of the utensil. The utensil can then be used to serve a portion of food. The utensil manipulating article is then returned to its open configuration so as to release the handle of the utensil. The utensil manipulating article can then be used so as to receive and use a subsequent serving utensil. When all serving of food are completed, the utensil manipulating article can be disposed into a trash receptacle.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A utensil manipulating article comprising:

a sleeve formed of a pliable material, said sleeve suitable for receiving the utensil therein, said sleeve movable between a utensil-receiving position and a utensil manipulating position, said sleeve having an adhesive material on an outer surface thereof, said adhesive material suitable for attaching to fingers of a user so as to allow the user to move the sleeve between said utensil-receiving position and said utensil-manipulating position, said adhesive material comprising a first adhesive strip extending along one side of said sleeve and a second adhesive strip extending along an opposite side of said sleeve, each of said first adhesive strip and said second adhesive strip having an adhesive on a surface thereof opposite said sleeve.

2. The utensil manipulating article of claim 1, said sleeve having an open end at one end thereof and a closed end at an opposite end thereof.

3. The utensil manipulating article of claim 1, said first adhesive strip and said second adhesive strip being defining a tab extending outwardly of an end of said sleeve.

4. The utensil manipulating article of claim 1, further comprising:

a liner removably affixed to the adhesive and over said first and second adhesive strips, said liner having a non-adhesive outer surface.

5. The utensil manipulating article of claim 4, said liner having a flap formed thereon, said flap suitable for allowing a user to remove said liner from said first and second adhesive strips.

6. The utensil manipulating article of claim 4, said liner extending continuously along a length of said first and second adhesive strips.

7. The utensil manipulating article of claim 1, said first adhesive strip extending lengthwise along said one side of said sleeve, said second adhesive strip extending lengthwise along said opposite side of said sleeve.

8. The utensil manipulating article of claim 7, said first adhesive strip positioned centrally on said one side, said second adhesive strip positioned centrally on said second side.

9. The utensil manipulating article of claim 1, said sleeve having a first end and a second end, said first end suitable for receiving the utensil therein, the article further comprising:

a tab affixed to said sleeve and extending outwardly of said second end of said sleeve.

10. The utensil manipulating article of claim 1, said sleeve having a first edge and a second edge formed between a first side and a second side thereof, each of said first and second edges being gusseted.

11. A utensil manipulating article comprising:

a sleeve formed of a pliable material, said sleeve suitable for receiving the utensil therein, said sleeve movable between a utensil-receiving position and a utensil-manipulating position, said sleeve having an adhesive material on an outer surface thereof, said adhesive comprising a first adhesive strip extending along one side of said sleeve and a second adhesive strip extending along an opposite side of said sleeve, each of said first adhesive strip and said second adhesive strip having an adhesive on a surface thereof opposite said sleeve, said first and second adhesive strips suitable for attaching to fingers of a user so as to allow the user to move the sleeve between the utensil-receiving position and the utensil-manipulating position.

12. The utensil manipulating article of claim 11, said first adhesive strip and said second adhesive strip defining a tab extending outwardly of an end of said sleeve.

13. The utensil manipulating article of claim 11, further comprising:

a liner removably affixed over said first and second adhesive strips, said liner having a non-adhesive outer surface.

14. The utensil manipulating article of claim 13, said liner having a flap formed thereon, said flap suitable for allowing a user to remove said liner from said first and second adhesive strips.

15. The utensil manipulating article of claim 11, said first adhesive strip extending lengthwise along said one side of said sleeve, said second adhesive strip extending lengthwise along said opposite side of said sleeve.

16. The utensil manipulating article of claim 11, said first adhesive strip positioned centrally on said first side, said second adhesive strip positioned centrally on said second side.

17. The utensil manipulating article of claim 11, said sleeve having a first end and a second end, said first end suitable for receiving the utensil therein, said second end being a closed end, the article further comprising:

a tab affixed to said sleeve and extending outwardly of said second end of said sleeve.

18. A method of preventing cross-contamination at a food buffet, the method comprising:

forming a sleeve of a pliable material, said sleeve having an open end, said sleeve having an adhesive material on an outer surface thereof;

positioning fingers of a user onto the adhesive material so as to move said open end of said sleeve to a utensil-receiving position;

inserting an end of the utensil into said sleeve through said opening end; and compressing sides of said sleeve by the fingers of the user so as to grasp the utensil.

19. The method of claim 18, further comprising:

removing a liner from over the adhesive material prior to the step of position fingers.

* * * * *